US006349542B1

(12) United States Patent
Moore, III

(10) Patent No.: US 6,349,542 B1
(45) Date of Patent: Feb. 26, 2002

(54) SILICON CARBIDE (SIC) COMPOSITE EXHAUST MANIFOLD AND METHOD OF MAKING IT

(75) Inventor: Dan T. Moore, III, Cleveland Heights, OH (US)

(73) Assignee: Soundwich, Inc., Cleveland, OH (US)

( * ) Notice: Subject to any disclaimer, the term of this patent is extended or adjusted under 35 U.S.C. 154(b) by 0 days.

(21) Appl. No.: 09/371,626

(22) Filed: Aug. 11, 1999

Related U.S. Application Data

(60) Provisional application No. 60/096,756, filed on Aug. 17, 1998.

(51) Int. Cl.[7] ..... F01N 7/10

(52) U.S. Cl. ..... 60/323; 60/322; 138/143; 501/134; 428/34.4; 428/36; 29/156.4 WL

(58) Field of Search ..... 60/323, 322, 272; 138/143; 501/134; 428/34.4, 36; 29/156.4 WL

(56) References Cited

U.S. PATENT DOCUMENTS

| | | | | | |
|---|---|---|---|---|---|
| 3,044,499 | A | * | 7/1962 | Frerich | 138/143 |
| 3,129,727 | A | * | 4/1964 | Tanaka | 138/143 |
| 3,141,479 | A | * | 7/1964 | Mickey | 138/143 |
| 3,568,723 | A | * | 3/1971 | Sowards | 138/143 |
| 3,864,908 | A | * | 2/1975 | LaHaye | 60/232 |
| 4,264,660 | A | * | 4/1981 | Siebels | 428/36 |
| 4,604,779 | A | * | 8/1986 | Narita et al. | 29/156.4 WL |
| 4,849,266 | A | * | 7/1989 | Dwivedi et al. | 428/34.4 |
| 5,055,435 | A | * | 10/1991 | Hamanaka et al. | 501/134 |
| 5,419,127 | A | | 5/1995 | Moore, III | 60/322 |

FOREIGN PATENT DOCUMENTS

| | | | | | |
|---|---|---|---|---|---|
| DE | 4216426 | A1 | * | 11/1992 | 60/272 |
| JP | 52047123 | | * | 4/1977 | 60/323 |
| JP | 60081420 | A | * | 5/1985 | 60/323 |
| JP | 60187712 | A | * | 9/1985 | 60/323 |
| JP | 62099612 | A | * | 5/1987 | 60/323 |

* cited by examiner

*Primary Examiner*—Thomas Denion
*Assistant Examiner*—Thai Ba Trieu
(74) *Attorney, Agent, or Firm*—Pearne & Gordon LLP

(57) ABSTRACT

An exhaust manifold for conducting heated exhaust gas from an internal combustion engine to an exhaust system. The exhaust manifold includes a preform and a metal layer enclosing the preform. The preform has an inner layer of silicon carbide, a middle layer of insulating material, and an outer layer to seal the middle layer from molten metal used to form the metal layer.

5 Claims, 1 Drawing Sheet

SILICON CARBIDE (SIC) COMPOSITE EXHAUST MANIFOLD AND METHOD OF MAKING IT

This application claims the benefit of U.S. Provisional Application No. 60/096,756, filed Aug. 17, 1998.

DESCRIPTION IN BRIEF

This disclosure describes a unique internal combustion engine exhaust manifold and low cost manufacturing process for making it.

The manifold is lined with a ceramic pre-form which, on the inside where it is in contact with the exhaust gases, is coated with a thin coating of SiC which is known for its toughness and its high temperature resistance. On the inside (ie, in the middle or in the middle layer) of the pre-form there is an insulating medium. The entire pre-form is covered with steel or aluminum so from the outside it looks like a normal cast exhaust manifold.

The invented exhaust manifold has three distinct advantages:

1. Because of its low heat inertia it allows the exhaust gases to heat up the catalytic converter more rapidly. There are three reasons why it works in this fashion.
   a. The silicon carbide shell is thin and lightweight and does not require as much energy to heat up as would a cast or fabricated steel manifold.
   b. Unlike stainless steel or a high nickel alloy steel, silicon carbide (SiC) has excellent chemical and heat resistance.
   c. A mineral insulation retains the heat in the inner liner of the manifold not allowing it to cool, particularly when the engine is heating up.
2. Because the manifold is so well insulated it is not necessary to have a protective heat shield on the outside of it. This saves the space and the expense of the heat shield while still protecting the temperature sensitive parts inside the engine compartment from the hot exhaust manifold.
3. Because the manifold contains layers of different types of material it does not transmit noise effectively. It does not resonate as much as thin walled fabricated steel manifolds do. On an automobile this reduces the need for auxiliary sound attenuation material such as the sound absorbing blanket on the cowl of the car.

RELATED ART

Making an exhaust manifold with low thermal inertia has been a difficult and challenging endeavor. A former invention, U.S. Pat. No. 5,419,127 (the entire contents of which are incorporated herein by reference in their entirety as if fully rewritten hereat), assigned to Soundwich, Inc., describes a low inertia manifold using ceramic beads and a thin interior liner of high alloy metal, which would be in contact with the exhaust gases. This achieved the light-up goals, but even using high nickel alloys, like inconel, one could not obtain sufficient chemical and thermal resistance to provide sufficient durability. Because the ceramic beads provided so much insulation the inside skill became excessively hot causing the interior liner to decompose more rapidly.

The same is true with insulated fabricated stainless steel manifolds. Although they heat up quickly, faster than cast manifolds, they cannot be relied upon for durability.

If this were viewed as a purely metallurgical problem, it could probably be solved using expensive alloys; however, the cost bogey (in 1997 prices) for a fast light off exhaust manifold for a V-6 engine, is only $25–30 per manifold (two required for each engine). This would no where nearly cover the cost of a high alloy material selection.

DETAILED DESCRIPTION OF THE PREFERRED EMBODIMENTS OF THE INVENTION

The invention covers a fibrous or cellular pre-form, generally of a ceramic composition, encapsulated on the inside surface and preferably the outside surface with a silicon carbide (SiC) coating. This disclosure defines both this enclosure and a means of making it in a rapid, high-production fashion. Although the illustrations are primarily focused on automobile exhaust manifolds it also covers other parts where a metal is cast over a SiC layer or substrate—or a derivative or close cousin of SiC.

Pre-Form

Figure 1:
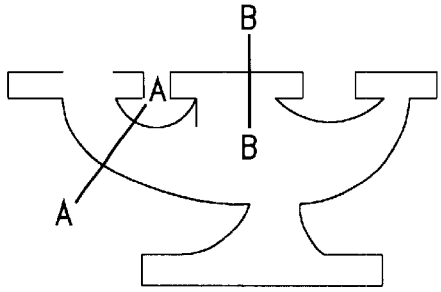
FIG. 1. is a schematic top view of an exhaust manifold of the present invention for one side of a typical six cylinder engine.
Figure 2:
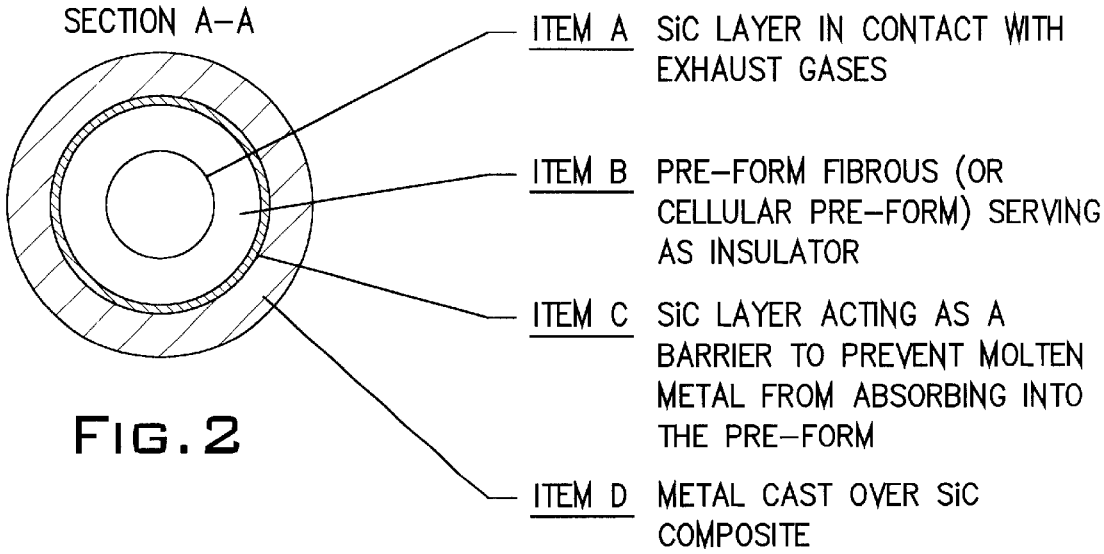
FIG. 2 is a cross-sectional view, not necessarily to scale, taken along line A—A in FIG. 1.

The pre-form has three distinct parts:

The inside of the pre-form in contact with the exhaust gases (FIG. 2—Item A)

The objective of this part of the pre-form is to "coat" the inside of the pre-form so that it can survive the heat and turbulence of the exhaust gases. The coating or hard shell is SiC. It must be thick enough to be durable yet thin enough to conduct as little heat away from the exhaust stream as possible during the "light off" of the catalytic converter immediately after the car has been started. The SiC layer will generally be less than 0.100" thick. The SiC surface in the preferred process is produced insitu by saturating the inner layer of a pre-form with carbon and later reacting the carbon with silicon. The difficult part of selecting the pre-form material is that this inner layer of the pre-form must selectively absorb large amounts of carbon without letting significant amounts of carbon get into the inside or insulating area of the pre-form. Although it must have a comparatively tight lattice work, it must have large numbers of voids that will accept high volume percentages of carbon through a means that will be discussed infra.

In an alternative process the powdered carbon and silicon are mixed together and are then saturated into the outer shell (or inner shell) of the pre-form and are later heated to high temperature to allow the reaction to take place which creates SiC. In this alternative process the pre-form must have the same lattice work and porosity as described above.

The interior of the pre-form (FIG. 2—Item B)

The inside of the pre-form is predominantly fibrous material such as ceramic fiber insulting material (FIG. 2—Item B)—It must withstand processing temperatures of 1420° C.—the processing temperature of silicon. Its purpose is to insulate the exhaust gas. Retaining the heat within the manifold allows the catalytic converter to heat up more quickly.

The SiC coating or surface on the outside of pre-form (FIG. 2—Item C)

Item C of FIG. 2 is the SiC coating or surface on the outside of the pre-form. Its objective is to seal the molten metal from the interior of the pre-from so that the molten metal will not be absorbed or penetrate into the interior of the pre-form during the metal molding or casting process.

There are other ways to provide an impervious coating for the purpose of keeping metal out of the pre-form but the SiC approach is preferred since it can be applied as a bi-product of applying the more critical SiC surface on the interior of the manifold since the exterior surface of the pre-form can be coated at almost no additional cost. Other techniques which would provide an imperviousness to the pre-form are as follows:

1. A dip in a binder material. The pre-form can be dipped in a thermal set or thermoset mixture of sand and binder. The binder is a lower viscosity cousin of the sand molding materials that are used to define the inner cavity of a metal casting. The binder can be applied by dipping the pre-form (after sealing off the interior portion or off the manifold or it can be applied in the same vacuum coating process in which the pre-form is made).
2. Coat with impervious slurry. A molding coating such as is used in investment casting could be vacuum cast or sprayed on the outside of the pre-form to make the pre-form impervious to molten metal.
3. A clay application. The pre-form can be covered with a silicon clay or some other inorganic material that would be impervious to molten metal.

The outer surface of the pre-form is not intended to form a crack free composite after the metal has been cast over it. As the metal cools it is permissible for the pre-form surface to crack and delaminate from the metal surface. The coefficients of thermal expansion will the different for the silicon carbide (SiC) than nearly any metal that's used. The cracking or the delamination of the exterior surface of the silicon carbide (SiC) will not normally create a problem. However, it may become important to have certain parts of it delaminate preferentially. This can be done by coating the silicon carbide (SiC) with a powder or an extremely thin and low gasing layer of a resin.

Cast metal covering the exterior of the SiC coated pre-form (FIG. 2—Item D)

There is a cast metal which will cover the exterior of the SiC coated pre-form. Its purpose is to provide stiffness, ductility and strength to the manifold and to provide a secondary seal for exhaust leaks.

In a typical embodiment the sample manifold such as the cast metal can be made from steel because it is inexpensive. At a cost premium aluminum can be used as the cast metal, it is lighter in weight and could typically save approximately 4 lbs. per car and because of its improved heat conductivity it will be less apt to have hot spots.

Processing

The processing can be divided into five parts.

1. Making the pre-form
2. Saturating the pre-form with carbon
3. Silicon impregnation and reaction with carbon
4. Preparing the SiC coated pre-form for casting
5. Casting Making the Pre-form In its preferred embodiment the pre-form is made from a mixture of ceramic fibers and various other minerals and binders. These are deposited upon a screen by sucking a slurry containing the ingredients to be formed onto a screen and then drying the resulting pre-form in an oven. Various binders can be used which provide the pre-form with greater rigidity. The pre-form can be made with several distinct layers for example, the inner layer (closest to the exhaust stream) could be a loose matrix of material that would accept substantial quantities of carbon. On top of that (in the middle of the pre-form) could be a layer of silica or alumina fiber. On the outer part of the pre-form could be an additional layer of impervious material that could accept high quantities of carbon.

In an alternative design the pre-form could be made in three separate layers laminated together. In this embodiment the inner layer can be sprayed with a material that does permit carbon to infiltrate beyond the two outer layers. The outer two laminates would then be coated with the ingredients which would create the silicon carbide (SiC) coating.

When the fibrous pre-form is being created, controlling the thickness is accomplished by monitoring the amount of suction behind the pre-form. The higher the level of suction the greater amount of fiber has been deposited. Making pre-forms in this fashion is well known and there are many pre-form suppliers making parts in this fashion in both the United States and Europe.

If there is only one mixture of material to be applied for the entire pre-form the process is easy and routine. It becomes more complicated if the pre-form must be cycled into another slurry tank to apply a different slurry formula. However, this is routinely done.

There is however, an alternative to vacuum applying different layers on the pre-form. This can be accomplished by applying ceramic paper over the pre-form. Generally the paper is die cut, moistened and then applied to the pre-form. In the case of the manifold the outer layers of the pre-form must be extremely porous so it is possible to saturate large percentages of carbon into it.

Saturating the Pre-form with Carbon

There are two ways to create silicon carbide (SiC) on the inside and the outside of the pre-form. The first approach involves saturating the outer layer of the pre-form with carbon then heating it in a oven with molten silicon at 1420° C. The silicon then saturates into the carbon creating silicon carbide (SiC). Another approach is to mix the carbon and the silicon together and saturate them into the pre-form. The reaction then occurs when they are heated over 1420°C.

The preferred embodiment defined by this disclosure is the first of the two examples.

The carbon is saturated into the pre-form by dipping the pre-form into aqueous or solvent based slurry of carbon. Successive dippings can be required. It is necessary to control 1.) the depth of saturation and 2.) the concentration density of carbon.

After the volatiles have be driven off and the carbon saturated pre-form is dry it is ready to be infiltrated with silicon.

It is also possible to saturate a ceramic fiber paper with carbon and then apply it to the pre-form (on both the outside and the inside of the pre-form). The advantage to this process is that the carbon can be saturated into the paper more accurately with greater depth control. It is possible that the carbon can be mixed with the ceramic fiber slurry and incorporated in the paper as it is made.

Ceramic paper is generally made by sucking ceramic fiber onto a large rotary drum which is turning slowly inside a slurry tank.

Silicon Impregnation in Reaction with Carbon

Silicon is melted in an oven in 1420° C. At that temperature the silicon vaporizes and permeates into the voids between the carbon particles within the pre-form. Within a short period of time silicon carbide (SiC) is formed. It is ideal that this process is accomplished in an inert atmosphere and does not necessitate a vacuum furnace.

In the case where the pre-form was saturated with a mixture of carbon and silicon it is only necessary to heat the part for an appropriate period of time.

In both of these cases silicon carbide (SiC) is produced insitu.

Preparing the Silicon Coated Pre-form for Casting

There are two different approaches for "casting in" the silicon carbide (SiC) coated pre-form into metal. The first involves encapsulating the pre-form in metal on all sides—including the openings in the manifold. This necessitates a two piece pre-form which is sealed together.

Later the ends are cut off the manifold with a diamond saw. The manifold is machined and inserts can be installed to smooth the flow of exhaust gases from the engine into the silicon carbide (SiC) enclosure.

In a second process the manifold is cast in a fashion that does not require sawing off the ends and the silicon pre-form is made to net shape. In this process the ends of the pre-forms need to be sealed with core material to prevent the metal from getting inside of the pre-form.

What is claimed is:

1. An exhaust manifold for conducting heated exhaust gas from an internal combustion engine to an exhaust system, said exhaust manifold comprising a preform and a metal layer enclosing the preform, said preform comprising a layer of insulating material and an outer sealing layer, said insulating material being ceramic fibers, a first portion of said layer of insulating material being proximal to said exhaust gas, a second portion of said layer of insulating material being distal to said exhaust gas, said outer sealing layer being a layer of material to seal the insulating material from molten metal used to form the metal layer, said first portion of said layer of insulating material being ceramic fibers coated with silicon carbide.

2. An exhaust manifold according to claim 1, wherein said outer sealing layer comprises silicon carbide.

3. An exhaust manifold according to claim 1, wherein said first portion of said layer of insulating material is formed by a process comprising the steps of saturating the first portion with carbon and later reacting the carbon with silicon.

4. An exhaust manifold according to claim 1, wherein said first portion of said layer of insulating material is formed by a process comprising the steps of saturating the first portion with a mixture of powdered carbon and silicon and later heating the first portion to a high temperature sufficient to cause a reaction which creates SiC.

5. An exhaust manifold according to claim 1, wherein said first portion of said layer of insulating material is formed by a process comprising the steps of saturating the first portion with an aqueous or solvent-based slurry of carbon and later reacting the carbon with vaporized silicon.

* * * * *

UNITED STATES PATENT AND TRADEMARK OFFICE

CERTIFICATE OF CORRECTION

PATENT NO. : 6,349,542 B1
DATED : February 26, 2002
INVENTOR(S) : Moore, III

It is certified that error appears in the above-identified patent and that said Letters Patent is hereby corrected as shown below:

Title page,
Item [54], please delete "(SIC)" and insert therefor -- (SiC) --.

Column 1,
Line 60, please delete "skill" and insert therefor -- skin --.

Figure 3:
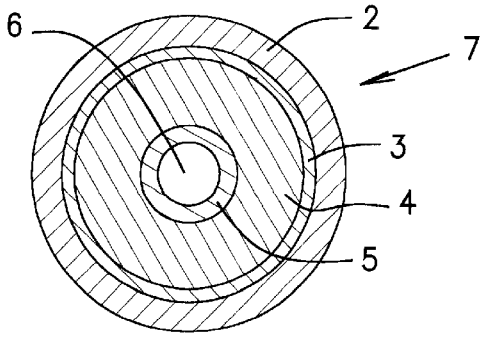
FIG. 3 shows a schematic cross-sectional view of an exhaust manifold 7 where the heated exhaust gases are conducted through passageway 6. The exhaust manifold 7 comprises a preform (layers 5, 4 and 3) and a metal layer 2 enclosing the preform. The preform comprises a layer of insulating material (layers 5 and 4) and an outer sealing layer 3. The layer of insulating material has a portion 5 which is proximal to the exhaust gas in passageway 6, and a second portion 4 which is distal to the exhaust gas in passageway 6.

Column 2,
Lines 13-21, please delete the entire paragraph and insert therefor -- FIG. 3 is a schematic cross-sectional view of an embodiment of the invention. --.

Column 5,
After line 27, please insert a new paragraph as follows -FIG. 3 shows a schematic cross-sectional view of an exhaust manifold 7 where the heated exhaust gases are conducted through passageway 6. The exhaust manifold 7 comprises a preform (layers 5, 4 and 3) and a metal layer 2 enclosing the preform. The preform comprises a layer of insulating material (layers 5 and 4) and an outer sealing layer 3. The layer of insulating material has a first portion 5 which is proximal to the exhaust has in passageway 6, and a second portion 4 which is distal to the exhaust gas in passageway 6.--

Signed and Sealed this

First Day of October, 2002

*Attest:*

*Attesting Officer*

JAMES E. ROGAN
*Director of the United States Patent and Trademark Office*